US012553212B2

(12) United States Patent
De Bruyne et al.

(10) Patent No.: US 12,553,212 B2
(45) Date of Patent: Feb. 17, 2026

(54) DEEP-SEA MINING VEHICLE

(71) Applicant: DEEPTECH N.V., Ostend (BE)

(72) Inventors: Kris De Bruyne, Antwerp (BE); Harm Stoffers, Dorst (NL); Stéphane Flamen, Antwerp (BE)

(73) Assignee: Deeptech NV, Ostend (BE)

( * ) Notice: Subject to any disclaimer, the term of this patent is extended or adjusted under 35 U.S.C. 154(b) by 726 days.

(21) Appl. No.: 17/801,161

(22) PCT Filed: Feb. 19, 2021

(86) PCT No.: PCT/IB2021/051445
§ 371 (c)(1),
(2) Date: Aug. 19, 2022

(87) PCT Pub. No.: WO2021/165918
PCT Pub. Date: Aug. 26, 2021

(65) Prior Publication Data

US 2023/0074267 A1 Mar. 9, 2023

(30) Foreign Application Priority Data

Feb. 20, 2020 (BE) ..... 2020/5114

(51) Int. Cl.
*E02F 3/88* (2006.01)

(52) U.S. Cl.
CPC ..... *E02F 3/8866* (2013.01)

(58) Field of Classification Search
CPC ..... E02F 3/8866; E02F 3/8858; E02F 3/88; E02F 3/8841; E02F 7/00; E02F 7/005; E02F 7/02
(Continued)

(56) References Cited

U.S. PATENT DOCUMENTS 4,042,279 A * 8/1977 Asakawa ..... E21C 50/00 299/8
4,503,629 A * 3/1985 Uchida ..... E02F 7/005 37/313
6,017,400 A * 1/2000 Clark ..... E02F 3/902 210/167.16

FOREIGN PATENT DOCUMENTS

CN 1167872 A * 12/1997
CN 105952457 A * 9/2016 ..... E21C 50/00
(Continued)

*Primary Examiner* — Christopher J Sebesta
*Assistant Examiner* — Evan A Bregel
(74) *Attorney, Agent, or Firm* — The Webb Law Firm

(57) ABSTRACT

Described is a deep-sea mining vehicle for taking up mineral deposits from a seabed at great depth, and optionally transporting said deposits to a floating device. The vehicle includes a support frame provided with means for moving the vehicle forward on the seabed, a storage for the mineral deposits taken up, and further a suction head with an open suction side which is directed toward the seabed and along which the mineral deposits are taken up. The taking up of the mineral deposits and the transport thereof to an outlet, which is connected to a suction conduit leading to the storage, is supported by a gap-like feed opening for water which is connected to an inlet of the suction head and by a pressure chamber for carrying the water at a high exit speed through the feed opening and toward the outlet along an internal wall part which mutually connects the feed opening and the outlet. The wall part is curved such that the distance to the open suction side of the deep-sea mining vehicle decreases from the inlet and then increases again toward the outlet.

14 Claims, 8 Drawing Sheets

(58) Field of Classification Search
USPC ..... 37/313, 307, 311, 317, 320, 334
See application file for complete search history.

(56) References Cited

FOREIGN PATENT DOCUMENTS

| | | | | | |
|---|---|---|---|---|---|
| CN | 109026008 | A | | 12/2018 | |
| CN | 109751051 | A | | 5/2019 | |
| GB | 2254890 | A | * | 10/1992 | ..... E02F 3/88 |
| KR | 101348111 | B1 | | 1/2014 | |
| KR | 101348112 | B1 | * | 1/2014 | ..... E21C 50/00 |
| KR | 101391634 | B1 | | 5/2014 | |

* cited by examiner

DEEP-SEA MINING VEHICLE

CROSS-REFERENCE TO RELATED APPLICATIONS

This application is the United States national phase of International Application No. PCT/IB2021/051445 filed Feb. 19, 2021, and claims priority to Belgian Patent Application No. 2020/5114 filed Feb. 20, 2020, the disclosures of which are hereby incorporated by reference in their entirety.

BACKGROUND OF THE INVENTION

Field of the Invention

The invention relates to a deep-sea mining vehicle for collecting mineral deposits on a seabed at great depths and transporting said deposits to a floating device or other storage above water. The invention likewise relates to a method for collecting mineral deposits at great depths with the deep-sea mining vehicle, and to a suction head for use in a deep-sea mining vehicle. The mineral deposits can comprise polymetallic nodules, such as manganese nodules.

Description of Related Art

In view of the growing world population and increasing scarcity of natural resources, there is an increasing need for groundbreaking technologies for deep-sea mining. Polymetallic nodules occur on the floors of a number of oceans and contain essential raw materials, such as nickel, cobalt and manganese. After extraction, the metals present in the polymetallic nodules can for instance be applied in stainless steel, batteries, wind turbines, photovoltaic systems and other useful applications.

In deep-sea mining the seabed can lie a distance of 4000-6000 m and more from the sea surface, and deep-sea mining devices must therefore be able to withstand the high pressures and other difficult conditions prevailing at such depths in the vicinity of the seabed.

A deep-sea mining vehicle is generally lowered toward the seabed from a deep-sea mining ship. Use can be made here of launching devices designed particularly for this purpose, which can if desired be adapted to the design of the deep-sea mining vehicle. A riser pipe or riser string arranged between the deep-sea mining vehicle and the deep-sea mining ship further ensures that mineral deposits collected by the deep-sea mining vehicle are carried from the seabed to a storage situated above the water surface. For this purpose the deep-sea mining ship is provided with suitable pumping equipment. If desired, pumps can also be incorporated in the riser string at determined water depths. A flexible connection between the riser string and the deep-sea mining vehicle ensures that the vehicle is able to move relatively freely over the seabed.

KR 101 348 112 B1, KR 101 391 634 B1 and KR 101 348 111 B1 show a deep-sea mining vehicle provided with a suction head with an open suction side which is directed toward the seabed and along which the mineral deposits are taken up. The taking up of the mineral deposits and the transport thereof to an outlet is supported by a feed opening for water which is connected to an inlet of the suction head. The water is led toward the outlet via the open suction side.

CN 109 026 008 A, U.S. Pat. Nos. 4,503,629 A and 4,042,279 A disclose other mining vehicles.

It will be apparent that collecting polymetallic nodules and then transporting the collected polymetallic nodules to a floating device above the water surface must take place as efficiently as possible, considering the difficult conditions on site.

SUMMARY OF THE INVENTION

The present invention has for its object, among others, to provide a deep-sea mining vehicle whereby mineral deposits can be collected at great depths with an increased efficiency relative to the prior art.

For this purpose the invention comprises a deep-sea mining vehicle as described herein. The deep-sea mining vehicle for taking up mineral deposits from a seabed at great depth, and optionally transporting said deposits to a floating device, comprises a support frame provided with means for moving the vehicle forward on the seabed, with an at least temporary storage for the mineral deposits taken up, and further with a suction head with an open suction side which is directed toward the seabed and along which the mineral deposits are taken up, wherein the taking up of the mineral deposits and the transport thereof to an outlet, which is connected to a suction conduit leading to the storage, is supported by a gap-like feed opening for water which is connected to an inlet of the suction head and by a pressure chamber for carrying the water at a high exit speed through the feed opening and toward the outlet along an internal wall part which mutually connects the feed opening and the outlet, which wall part is curved such that the distance to the open suction side of the deep-sea mining vehicle decreases from the inlet and then increases again toward the outlet.

The curvature of the wall part, among other things, in combination with the gap-like feed opening and the exit angle of the gap-like feed opening provide for a more efficient take-up of the mineral deposits, such as manganese nodules, from the seabed. The exit angle of the gap-like feed opening preferably lies between 0° and 45° relative to the horizontal plane, preferably between 20° and 40°.

An embodiment of the invention relates to a deep-sea mining vehicle wherein the gap-like feed opening extends in a direction running parallel to a width direction of the suction head. The gap-like feed opening provides for a more uniform and continuous flow profile at the position of the open suction side, and furthermore advances a better attachment of the flow to the internal wall part. Flow losses may be reduced hereby. The gap-like feed opening ensures that the desired flow profile is achieved more quickly.

In yet another embodiment of the invention a deep-sea mining vehicle is provided wherein a cross-section of the gap-like feed opening is variable. The variable gap-like feed opening enables higher exit speeds, which may result in a more efficient suctioning of the mineral deposits.

A further embodiment is obtained by a deep-sea mining vehicle wherein a height of the gap-like feed opening is variable. The suction action of the deep-sea mining vehicle can hereby be adjusted depending on the (expected) properties of the mineral deposits.

Another embodiment relates to a deep-sea mining vehicle wherein the inlet has a teardrop-shaped cross-section and the teardrop debouches in the gap-like feed opening. With these measures a hydrodynamically optimized flow is obtained in the direction of the feed opening, and thereby a further increased efficiency.

Yet another embodiment relates to a deep-sea mining vehicle wherein the gap-like feed opening has an upper wall which runs continuously into the wall part. The upper wall of the gap-like feed opening and the wall part can thus optionally be formed from the same plate. The extended upper wall of the present embodiment provides an improved attachment of the water flow to the upper wall of the wall part. This results in less turbulence and so a more uniform, continuous flow over the width of the suction head.

In a further improved embodiment a deep-sea mining vehicle is provided wherein the wall part has a convex curvature from the inlet, comprises a linear middle part, and a wall part which has a concave curvature and connects to the outlet. The convex-straight-concave form of the upper wall in this embodiment provides for an optimized flow profile which on the one hand imparts as efficiently as possible a kinetic momentum to the taken-up mineral deposits and on the other hand discharges the mineral deposits as efficiently as possible to the outlet connected to the suction conduit leading to the storage. The linear middle part can have a length of 0 m to 3 m, more preferably 0.1 m to 2.5 m. If desired, a wall part with a convex form can be situated between the linear middle part and the wall part which has a concave curvature and connects to the outlet.

Yet another embodiment provides a deep-sea mining vehicle wherein the height of the linear middle part relative to a plane of the open suction side lies between 0 and 200 mm, and more preferably between 20 and 110 mm. The plane of the open suction side can be defined by lower edges of vertically running strengthening plates. These lower edges can come into contact with the underwater bottom but will generally be held at a relatively small distance above the underwater bottom during operation.

The angle formed by a longitudinal axis of the suction conduit with a horizontal can in principle be chosen within limits. A further optimized deep-sea mining vehicle has the feature that the angle formed by a longitudinal axis of the suction conduit with a horizontal plane lies between 30° and 80°, and more preferably between 40° and 50°. The selection of the angle of the suction conduit is a consideration weighing up the counteraction of the gravitational force on the mineral deposits—wherein the smallest possible angle relative to the horizontal is preferably opted for—and general structural and hydrodynamic properties of the vehicle—wherein the more compact the form of the vehicle, the greater the angle that is opted for.

A deep-sea mining vehicle according to yet another embodiment has the feature that the suction head comprises a second gap-like feed opening situated at the position of the outlet, and a second pressure chamber for carrying the water at a high exit speed through the second feed opening and toward the suction conduit which can be connected to the outlet. This improves the transport of taken-up mineral deposits to the suction conduit. The second gap-like feed opening helps improve the transport to the suction conduit. Due to the effect of the gravitational force, the mineral deposits will have a tendency to stay mainly on a lower side of the suction conduit. In order to help prevent the mineral deposits from "rolling back" the second water flow is maintained.

In an embodiment of the deep-sea mining vehicle the second pressure chamber is adjacent to the open suction side, and an underside of the second pressure chamber is provided with fingers for guiding taken-up mineral deposits. The fingers are placed relative to the open suction side present in a bottom surface of the suction head such that an underside of the fingers is situated above the seabed in use. In other words, the fingers are positioned high enough to prevent them from scraping in the seabed. The underside of the fingers lies above the linear middle part, whereby the linear middle part would touch the seabed first before the underside of the fingers were to touch the seabed.

Another embodiment provides a deep-sea mining vehicle wherein the suction head has a width and at least one of the wall part, the feed opening, the pressure chamber, the second pressure chamber and the outlet extends over the width of the suction head. The active parts of the suction head extending as widely as possible in this embodiment provides for optimization of the seabed surface area covered per passage of the vehicle, and so an optimization and further increase in production.

It is advantageous here for the wall part, the feed opening, the pressure chamber, the second pressure chamber and the outlet to all extend over the width of the suction head in the deep-sea mining vehicle according to an embodiment.

According to yet another embodiment, the production of the deep-sea mining vehicle can be improved when the vehicle comprises a number of suction heads disposed parallel to each other. The suction heads can here form a connected unit which can be operated collectively. It is preferably also possible to enable individual operation of the suction heads. It thus becomes possible to adapt the action of each suction head to the variability of the seabed, which can for instance be manifest in local height differences and/or the presence of possible obstacles, possibly with different dimensions.

It is advantageous here for the deep-sea mining vehicle to be characterized according to an embodiment in that the suction conduits of the suction heads disposed parallel to each other debouch into one or more storages, preferably the at least temporary storage. For reasons of structural engineering it is indeed possible for a plurality of storages to be provided.

Yet another embodiment provides a deep-sea mining vehicle wherein the suction head or plurality of suction heads are height-adjustable relative to the seabed, in the case of a plurality of suction heads preferably independently of each other. This makes it possible to allow the suction head to operate in its optimal operating range (height above the seabed), this independently of the local bottom properties, which can for instance cause sinking down of the vehicle. In other words, the height becomes adjustable relative to the support frame. The suction head preferably does not touch the seabed during deep-sea mining operations and preferably remains at an optimal height above the seabed. In an embodiment the height adjustment takes place by means of linear guides which are arranged on the suction conduit and extend in the direction of the longitudinal axis of the suction conduit. The actuation can take place using hydraulic cylinders.

Another aspect of the invention relates to a suction head for a deep-sea mining vehicle according to the invention. The suction head is provided with an open suction side which is directed toward the seabed and along which the mineral deposits are taken up, wherein the taking up of the mineral deposits and the transport thereof to an outlet, which is connected to a suction conduit leading to the storage, is supported by a gap-like feed opening for water which is connected to an inlet of the suction head and by a pressure chamber for carrying the water at a high exit speed through the feed opening and toward the outlet along an internal wall part which mutually connects the feed opening and the outlet, which wall part is curved such that the distance to the open suction side of the deep-sea mining vehicle decreases from the inlet and then increases again toward the outlet.

According to yet another aspect of the invention, a method is provided for taking up mineral deposits on a seabed at great depth and optionally transporting said deposits to a floating device. The method comprises of providing a deep-sea mining vehicle according to the invention, connecting the deep-sea mining vehicle to a suspension cable provided between the floating device and the deep-sea mining vehicle, lowering the deep-sea mining vehicle toward a seabed, and moving the deep-sea mining vehicle forward over or on the seabed in order to take up the mineral deposits.

In a further embodiment the deep-sea mining vehicle is hauled in toward the floating device after collecting of the mineral deposits.

The embodiments of the invention described in this patent application can be combined in any possible combination of these embodiments. Each embodiment can individually form the subject-matter of a divisional patent application.

BRIEF DESCRIPTION OF THE DRAWINGS

The invention will now be further elucidated on the basis of the following figures and description of a preferred embodiment, without otherwise being limited thereto. In the figures.

DESCRIPTION OF THE INVENTION

Figure 1:
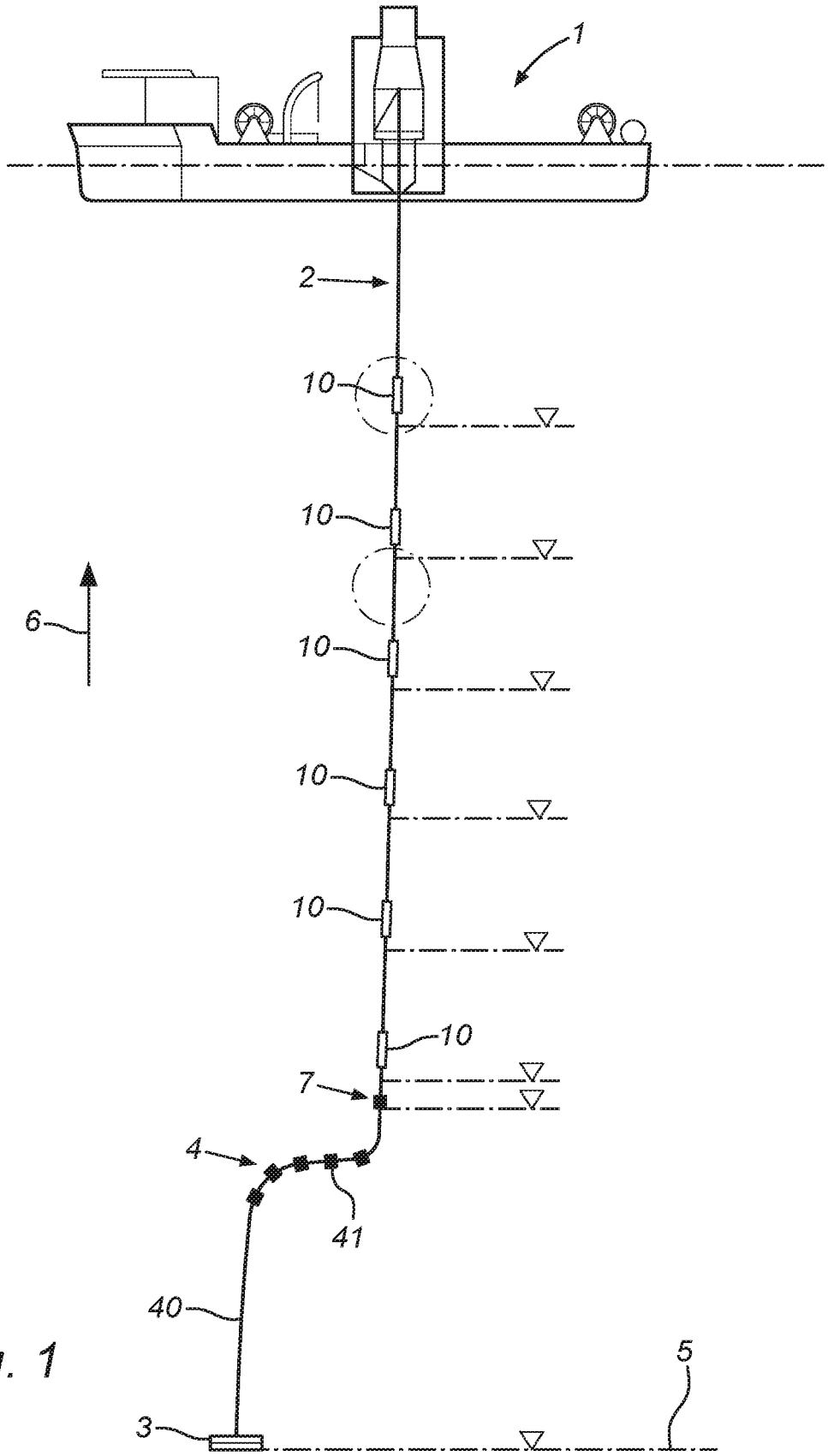
FIG. 1 is a schematic side view of an assembly of a floating vessel and a riser pipe connected thereto, to an underside of which is connected a deep-sea mining vehicle according to embodiment of the invention.

Referring to FIG. 1, a part is shown of a typical setup which is used in deep-sea mining of mineral deposits, such as polymetallic nodules. The setup typically comprises a transport system in the form of a tubular riser string 2 (which can have a length of several thousands of metres and connects to a floating vessel 1) to which mining equipment such as a deep-sea mining vehicle 3 is attached. A flexible connecting hose assembly 4 can be arranged between the lower end 7 of riser pipe 2 and the deep-sea mining vehicle 3 which is adapted to move on a deep-sea floor 5 and to collect mineral deposits therefrom.

Connecting assembly 4 comprises a flexible undersea hose 40 which is adapted to transport mineral nodules collected by vehicle 3 to the rigid riser pipe 2. Hose 40 can be provided with floating blocks 41 which compensate for the components' own weight and generate an upward force in a part of the hose and create an S-shape. Flexible connecting assembly 4 enables mining vehicle 3 to have a determined degree of freedom to move around on seabed 5, and ensures that the vehicle is not affected by the movements of riser pipe 2. In order to support and lift vehicle 3 steel hoisting cables (not shown) can be provided between the vessel 1 and the deep-sea mining vehicle 3. Power cables or umbilicals (not shown) are also provided between vessel 1 and deep-sea mining vehicle 3.

If desired, the transport system in the form of a tubular riser string 2 of extreme length can also comprise a number of pump modules 10 which are arranged in lengthwise direction. Pump modules 10 are adapted to pump up mineral deposits (nodules) from seabed 5 in an upward direction 6, which is oriented away from seabed 5 toward the sea surface. It is also possible to provide one pumping station (not shown) at the position of a lower side of riser string 2.

Figure 2:
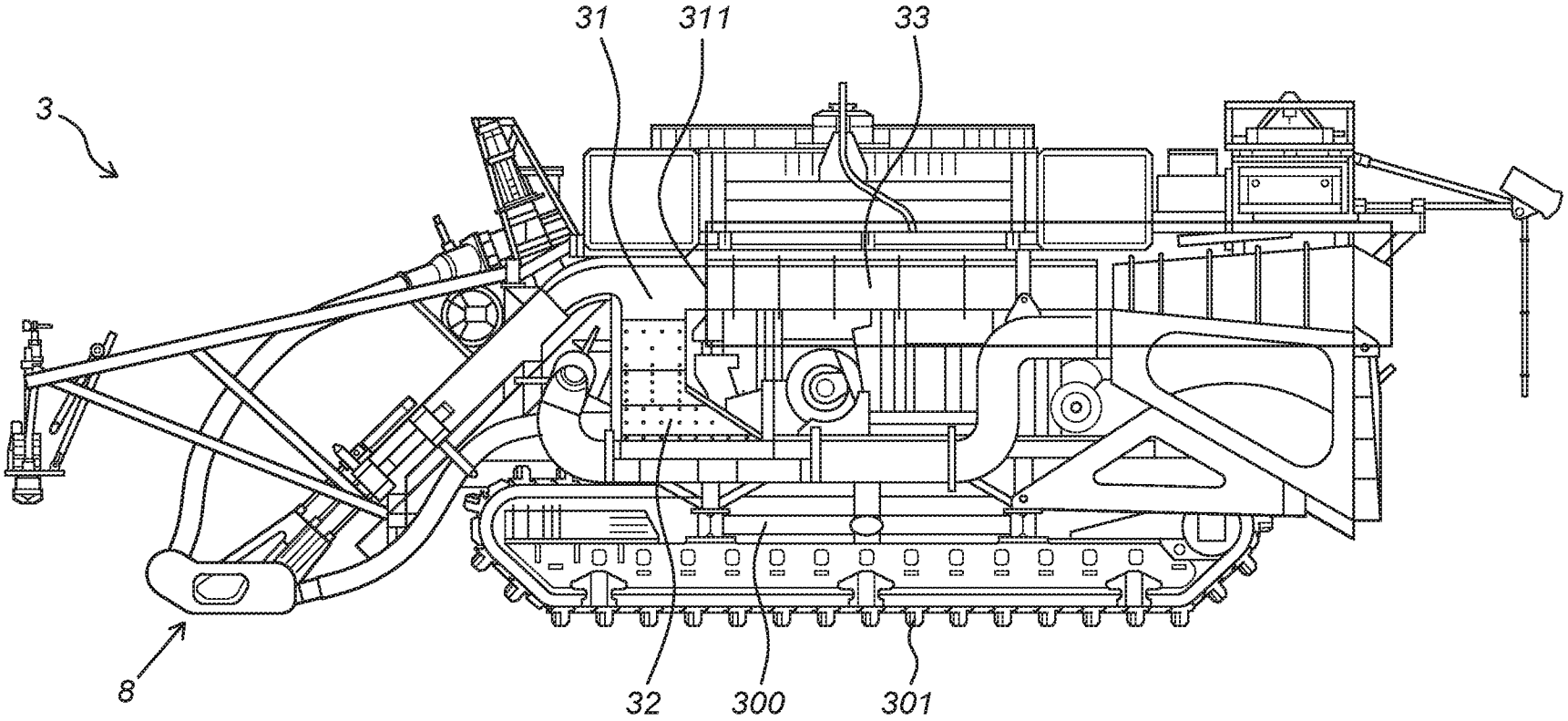
FIG. 2 is a schematic side view of a deep-sea mining vehicle according to an embodiment of the invention.

FIG. 2 shows a deep-sea mining vehicle 3 according to a preferred embodiment of the invention. Deep-sea mining vehicle 3 typically comprises a support frame 300 which is provided with means 301 for enabling deep-sea mining vehicle 3 to be moved, for instance over the seabed. Such means can take the form of caterpillar tracks 301, wheels or other moving means.

In order to be able to take up mineral deposits support frame 300 is typically provided with a nodule collecting head 8, a hopper 32 and an outlet 33. A mixture of, among other things, water and mineral deposit, which is taken up by nodule collecting head 8, is transported from the seabed to and into the deep-sea mining vehicle 3. In deep-sea mining vehicle 3, particularly in separating space 31, the mixture is split into at least two parts, for instance by arranging a filter 311 at an entrance of outlet 33. The mineral nodules are thus separated from the greater part of the water and several finer particles of the mixture. The water and finer particles of the mixture are ejected via outlet 33 at the position of a rear side of deep-sea mining vehicle 3, back into the surrounding area. The cross-section of outlet 33 increases toward the outer end so as to reduce the exit speed of the mixture at the rear side of the deep-sea mining vessel.

The mineral nodules are captured in hopper 32, which in this case serves as storage or as temporary storage. When deep-sea mining vehicle 3 forms part of a deep-sea mining setup as shown in FIG. 1, mineral nodules are optionally pumped via this temporary storage 32, optionally via a central discharge pipe of deep-sea mining vehicle 3, to the hose 40. In another embodiment it is possible for deep-sea mining vehicle 3 to be provided with a nodule bin (not shown) for collecting the mineral nodules. It will be apparent that, if desired, deep-sea mining vehicle 3 can comprise a plurality of hoppers 32 functioning as (temporary) storage.

Figure 3:
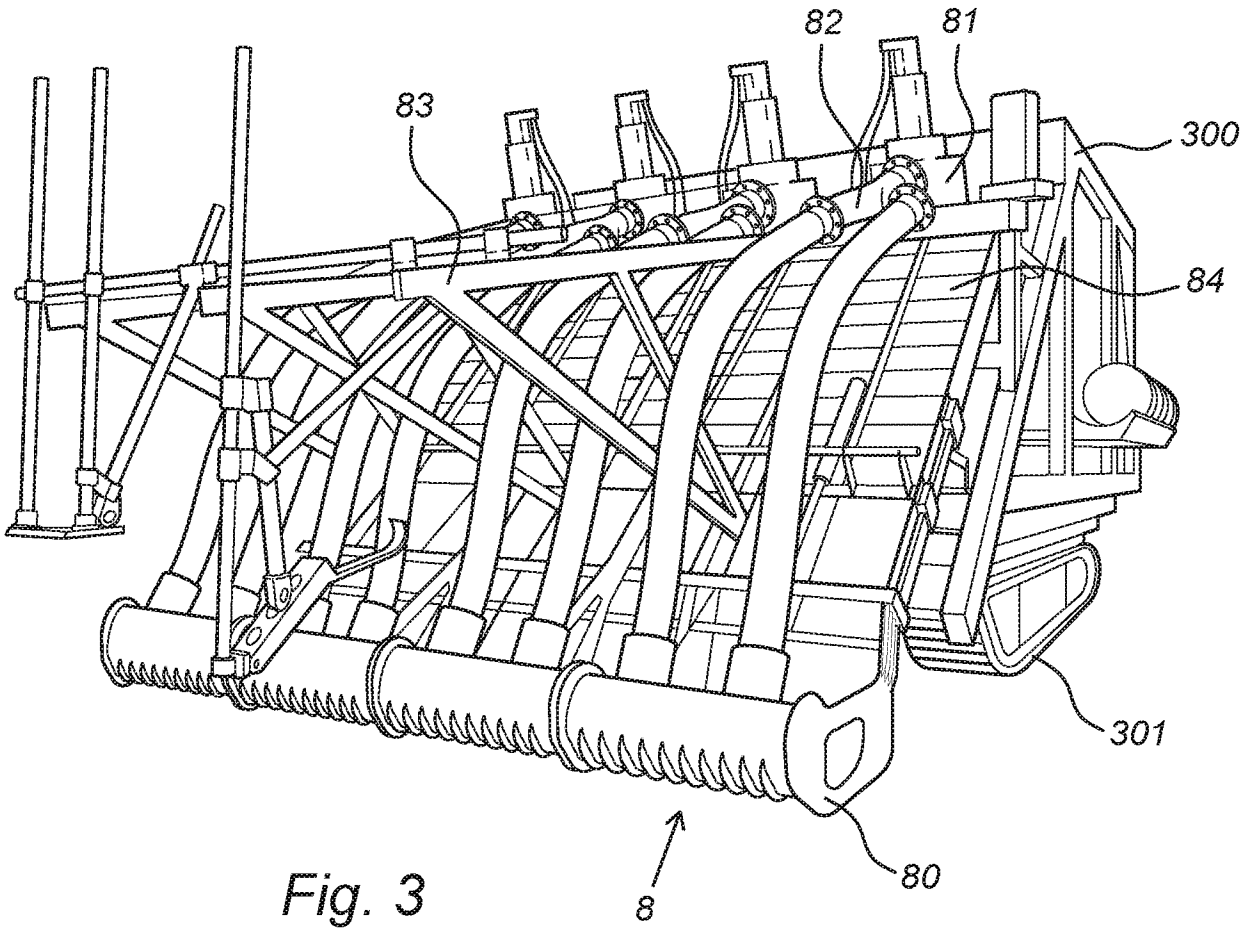
FIG. 3 is a schematic perspective front view of a deep-sea mining vehicle according to an embodiment of the invention.

FIG. 3 shows a schematic perspective front view of deep-sea mining vehicle 3 according to an embodiment of the invention. From this perspective, it can once again be seen that deep-sea mining vehicle 3 comprises support frame 300 and caterpillar tracks 301. This perspective particularly shows that deep-sea mining vehicle 3 can, in addition to one, also comprise a plurality of nodule collecting heads 8 disposed parallel to each other. The overall width of the collecting heads 8 can here be chosen freely and in some cases can amount to for instance 4-20 m, more preferably 10-16 m.

In a situation of use such nodule collecting heads 8 spray water over the seabed at a high speed so as to thus mix mineral deposit situated there with the supplied and surrounding water.

These nodule collecting heads 8 typically consist of pump 81, which provides water via one or more supply conduits to suction head 80 at a high exit speed. Pump 81 can also be shared between two or more nodule collecting heads, wherein it provides water to both heads. From suction head 80 water is sprayed onto the seabed at high speed, such that mineral deposits which may be situated there are mixed with the supplied and surrounding water. This mixture of water and seabed is taken up via the nodule collecting heads into deep-sea mining vehicle 3, after which it is processed as described above with reference to FIG. 2. From head 80, the mixture is received by means of suction conduit 84 in nodule collecting head 8.

The one or more nodule collecting heads 8 can be controlled on the basis of measurements taken of the surrounding area via a measuring installation mounted on a measuring installation frame 83.

Figure 4:
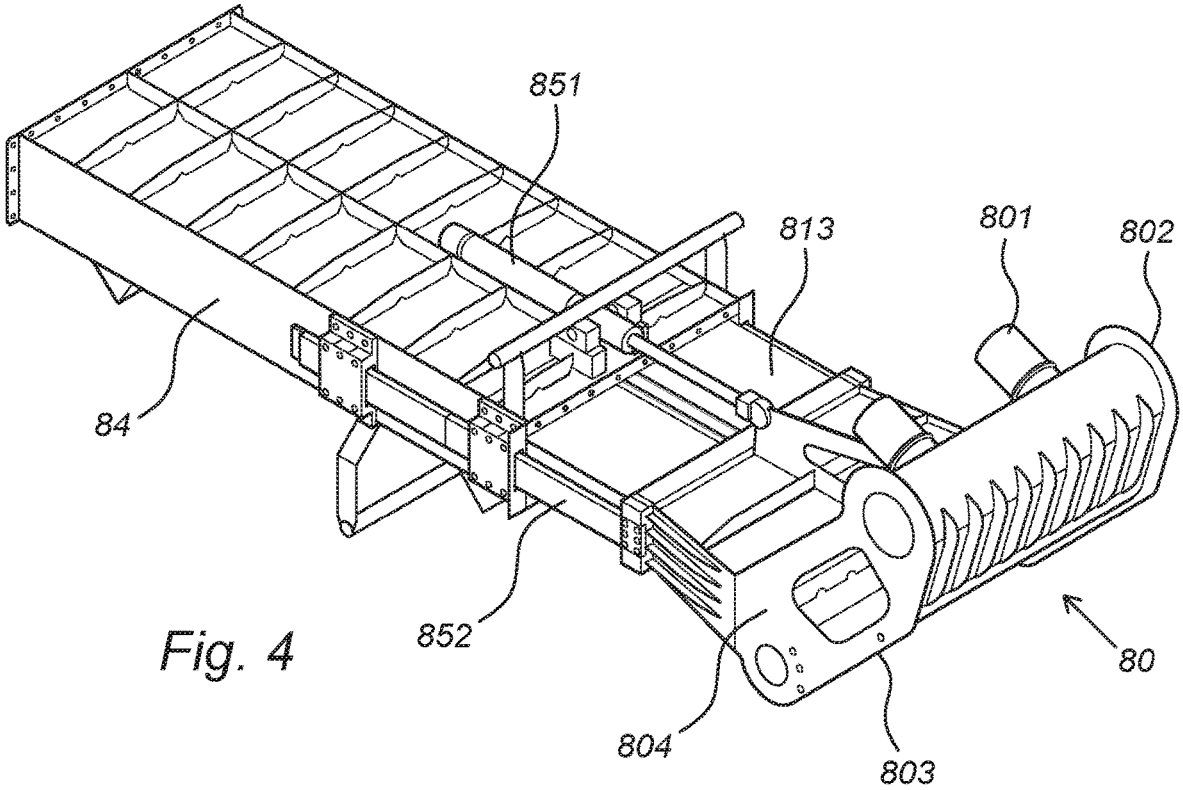
FIG. 4 is a schematic perspective front view of a suction head of the deep-sea mining vehicle according to an embodiment of the invention.
Figure 5:
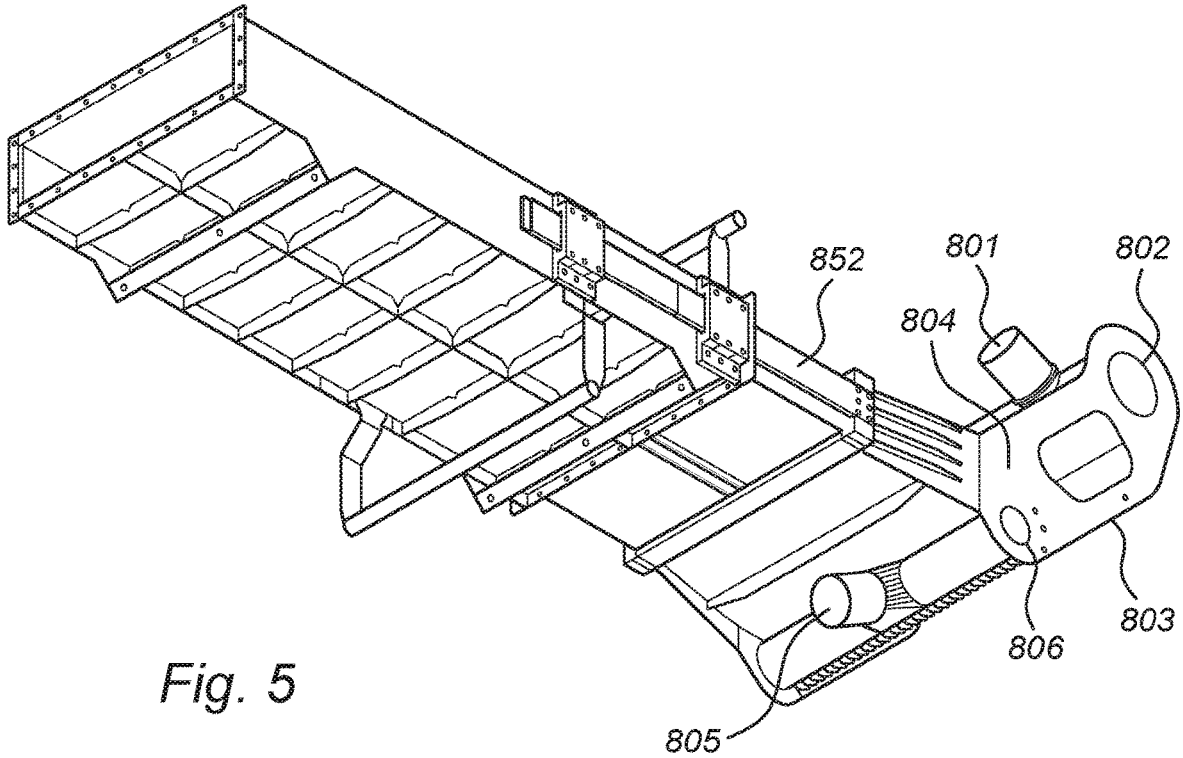
FIG. 5 is a schematic perspective rear view of the suction head of the deep-sea mining vehicle according to an embodiment of the invention shown in FIG. 4.

FIGS. 4 and 5 show respectively a schematic, perspective front and rear view of suction head 80 as part of nodule collecting head 8 of deep-sea mining vehicle 3, according to an embodiment of the invention. From this perspective it can once again be seen that nodule collecting head 8 consists, among other things, of suction head 80 and suction conduit 84. It can particularly be seen from this perspective that suction head 80 lies partially in suction conduit 84, wherein these elements are mutually connected by a height-adjusting actuator 851 and a guiding installation 852. Outlet 813, which has an outer periphery corresponding with an opening in suction conduit 84, is particularly arranged at least partially in suction conduit 84. Height-adjusting actuator 851 enables suction head 80 and suction conduit 84 to be adjustable relative to each other. This is achieved by moving outlet 813 of suction conduit 84 in or out. Guiding installation 852 is arranged in order to further support this linear movement. When suction conduit 84 is mounted on support frame 300, height-adjusting actuator 851 also enables displacement of suction head 80 relative to support frame 300, and so deep-sea mining vehicle 3. Suction head 80 can particularly be displaced along the longitudinal axis of suction conduit 84.

It can also be seen from this perspective that suction head 80 further consists of one or more water inlets 801, pressure chamber 802, open suction side 803, outlet 813, and an optional active suction space 804. Water which is provided from supply conduit 82 and is already under pressure is collected in pressure chamber 802 via one or more water inlets 801. From pressure chamber 802, the provided water is sprayed at high speed into open suction side 803, particularly in the direction of the outlet.

When a nodule collecting head 8, of which suction head 80 forms part, is installed on deep see mining vehicle 3, open suction side 803 is directed in an environment of use toward the bottom on which deep-sea mining vehicle 3 rests, for instance the seabed. In a collecting head 8 installed in such a manner the longitudinal axis of suction conduit 84 preferably forms an angle with a horizontal plane of between 30 and 60 degrees, and more preferably between 40 and 50 degrees.

By aiming the water flow toward the seabed or parallel to the seabed a water flow is realized from pressure chamber 802 to suction conduit 84, and in this way the mixture of water and mineral deposit is sucked into suction conduit 84. The flow of this mixture toward and into suction conduit 84 can be strengthened in the active suction space 804, for instance by spraying water into suction conduit 84 at high speed, in the suction direction of suction conduit 84. Water is supplied under high pressure to active suction space 804 via secondary water inlet 805. The secondary water inlet 805 ensures that there are fewer relatively low-speed zones in the suction conduit and there is less gravitational drop of the sucked-up mixture in outlet 813 and suction conduit 84. For this purpose the water can further be brought under pressure by a pump, for instance pump 81, and be provided to secondary water inlet 805 by a supply conduit, similar to supply conduit 82. With such an approach both mineral deposits situated on the seabed and mineral deposits buried partially in the seabed can be drawn up.

Figure 6:
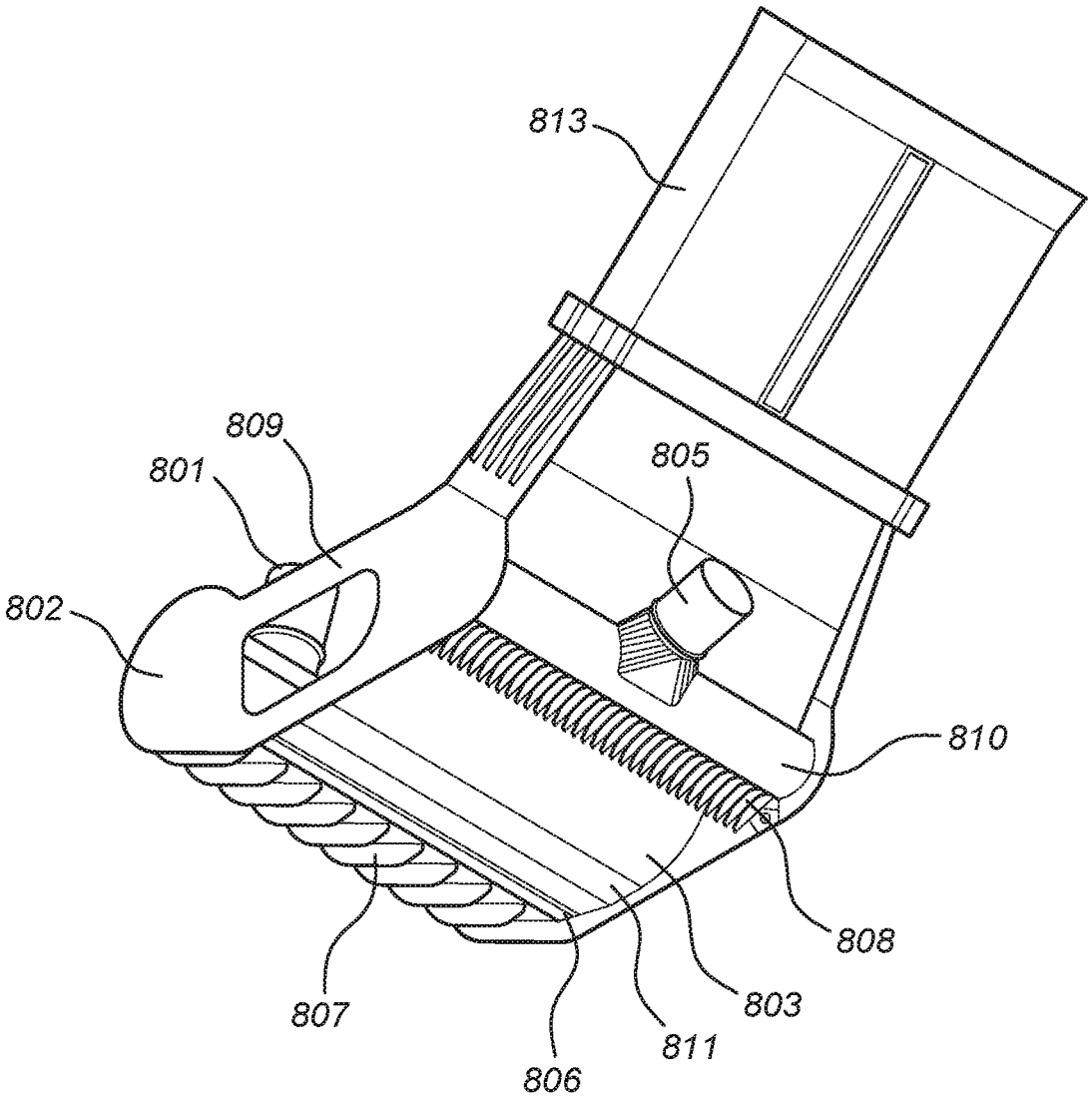
FIG. 6 is a schematic perspective bottom view of the suction head of the deep-sea mining vehicle according to an embodiment of the invention shown in FIG. 4.

FIG. 6 shows a schematic perspective bottom view of the suction head 80 of deep-sea mining vehicle 3 shown in FIGS. 4 and 5, according to an embodiment of the invention. Once again, this perspective shows that suction head 80 consists of water inlet 801, pressure chamber 802, and that an open suction side 803 is provided in suction head 80.

It can particularly be seen in this perspective that spraying of water into open suction side 803 at high speed is realized in that the connection between pressure chamber 802 and open suction side 803 consists of a gap-like feed opening 806. In order to further improve the throughflow the cross-section of pressure chamber 802 is preferably teardrop-shaped, wherein the teardrop debouches in gap-like feed opening 806. Because the section of feed opening 806 is significantly smaller than the section of water inlet 801, water is sprayed through feed opening 806 into open suction side 803 and toward suction conduit 84 at increased speed. Because the gap-like feed opening 806 is arranged parallel to and over the whole or almost the whole width of suction head 80, a water flow is further provided over the whole or almost the whole width of open suction side 803.

In a preferred embodiment the section of the gap-like feed opening 806 is variable. The height of gap-like feed opening 806 is preferably variable.

The water which is carried from gap-like feed opening 806 through open suction side 803 flows along an internal wall part 811 which mutually connects feed opening 806 and suction conduit 84. This wall part is curved such that the distance to the open suction side 803 decreases from the inlet and then increases again in the direction of the outlet. Feed opening 806 preferably has an upper wall which continuous into wall part 811.

In this perspective it can also be seen more clearly how secondary water inlet 805 can supply water to active suction space 804, this being because secondary water inlet 805 debouches into a secondary pressure chamber 810. Pressure chamber 810 is connected to feed opening 814. The outflow direction P6 of feed opening 814 preferably lies in the same longitudinal axis as suction conduit 84. An outlet 813 of suction head 80 is also shown here, without this being partially received in suction conduit 84. Outlet 813 of suction head 80 is disposed relative to the other elements of suction head 80 such that it lies in line with the effective active suction space 804, and thereby elongates it.

In order to strengthen suction head 80 it is provided with a connecting beam 809 which connects pressure chamber 802 to a part of suction head 80 lying further toward suction conduit 84.

A number of water inlet guide fins 807 is provided in order to ensure a more uniform and guided flow of surrounding water to the open suction side 803. A number of (dis)mountable fingers 808 is disposed such that they do not dig into the sediment. Fingers 808 have in the first place the object of avoiding sucked-up mineral deposits, such as manganese nodules, from shooting through and not ending up in outlet 813 and suction conduit 84. The nodules which are situated under the suction head and have already been set into motion by the water jets (and into which some pumping energy has thus already been put) should preferably be transported to and into outlet 813 and suction conduit 84.

Figure 7:
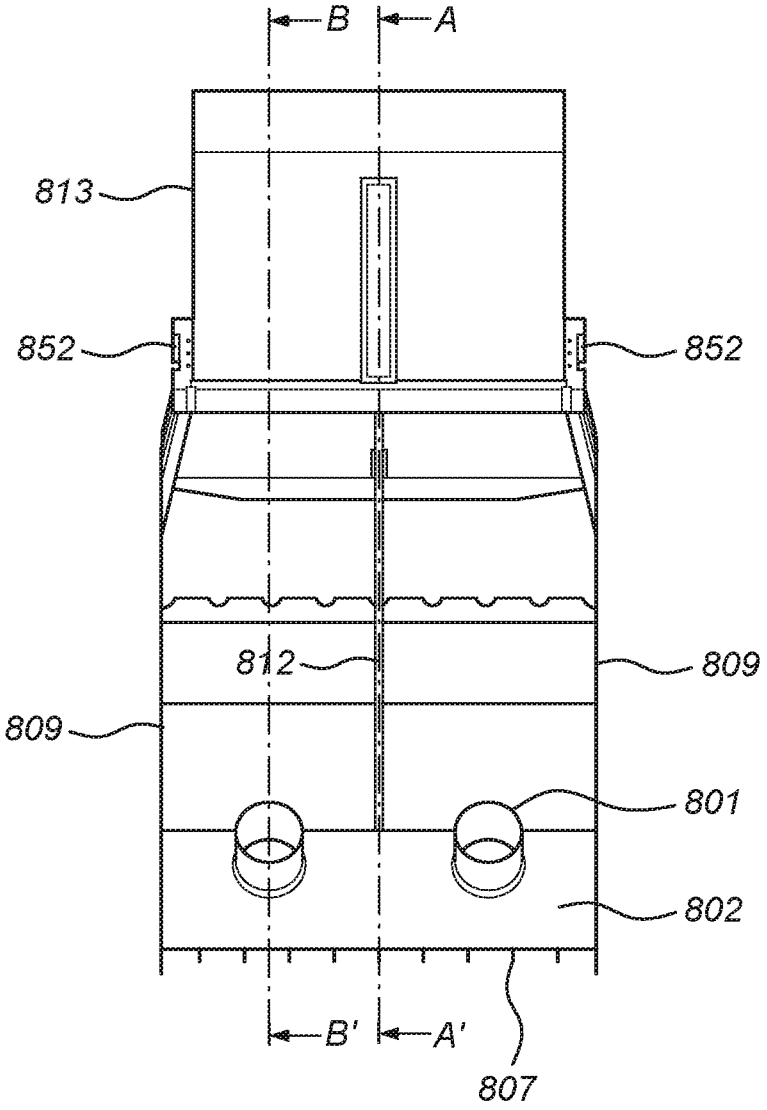
FIG. 7 is a schematic top view of a suction head of the deep-sea mining vehicle according to an embodiment of the invention.

FIG. 7 shows a schematic top view of suction head 80 according to an embodiment of the invention. This perspective once again shows that inlet 801 connects to pressure chamber 802 and that, in order to strengthen suction head 80, it is provided with one or more connecting plates 809, which form side walls of suction head 80. This perspective further shows that suction head 80 is strengthened by means of central plate 812 which connects internal wall part 811 to outlet 813 of suction head 80. Mounting parts of guiding installation 852 are also shown. The plane of the open suction side 803 can be defined by lower edges of the vertically running strengthening or connecting plates 809 and central plate 812. These lower edges can come into contact with the underwater bottom, but will usually be held at a relatively small distance above the underwater bottom during operation.

The strengthening elements are disposed in the longitudinal direction of suction head 80 such that they are suitable for preventing deformation when deep-sea mining vehicle 3 comes with the nodule collecting heads 8, which are generally installed on the front, into collision with its surroundings.

Relative to the width of suction head 80 at least one of wall part 811, feed opening 806, pressure chamber 802, second pressure chamber 810 and outlet 813 preferably extends over the width of suction head 80, more preferably of the whole width.

Figure 8:
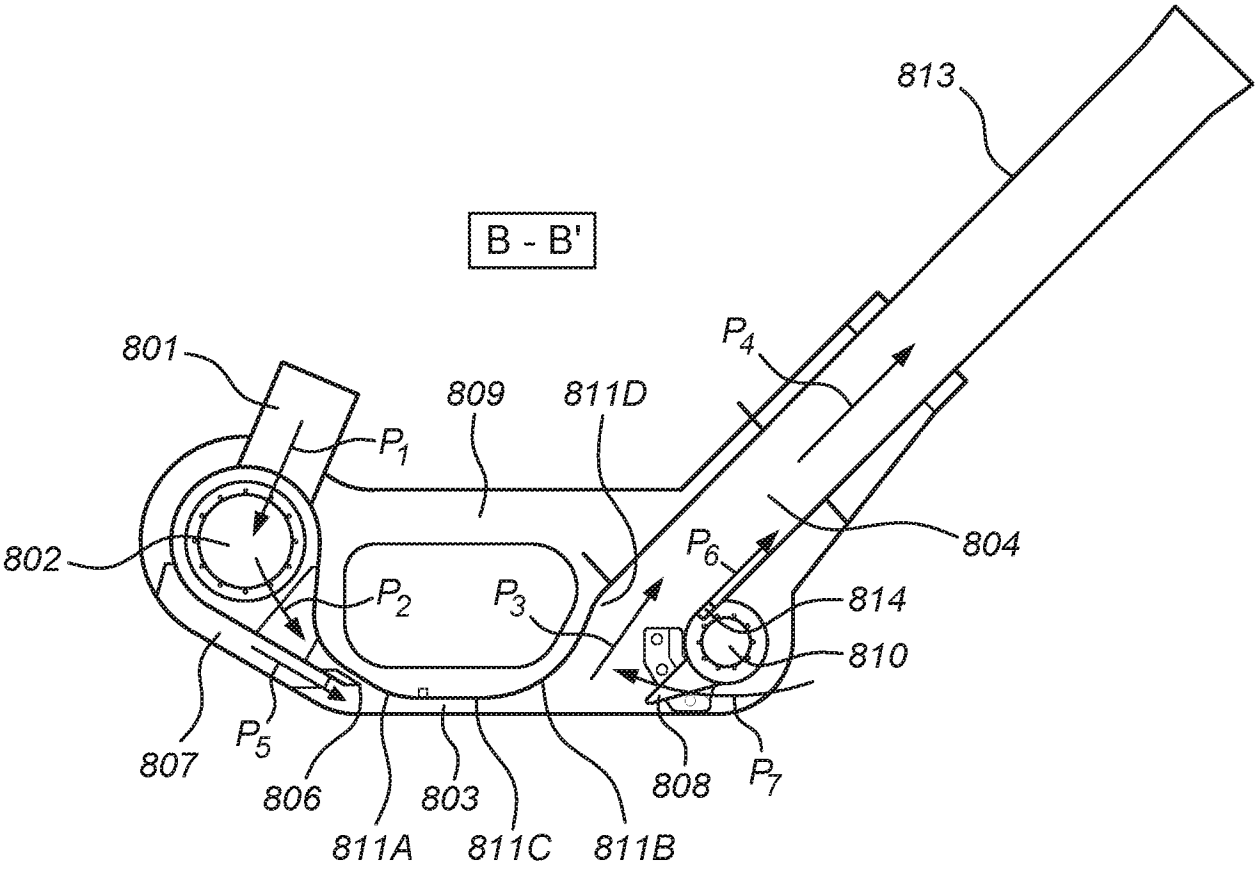
FIG. 8 is a schematic cross-section along the line B-B' of the suction head of the deep-sea mining vehicle according to an embodiment of the invention shown in FIG. 7.
Figure 9:
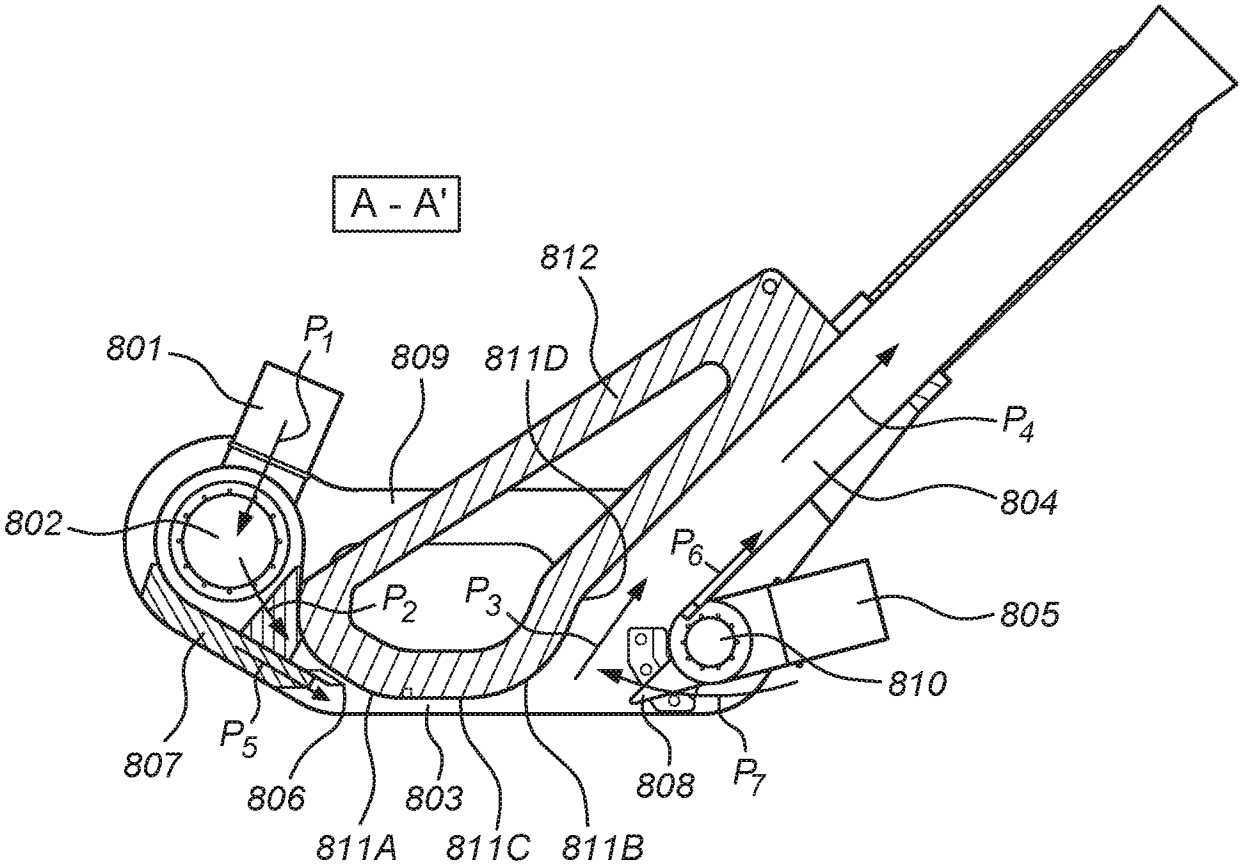
FIG. 9 is a schematic cross-section along the line A-A' of the suction head of the deep-sea mining vehicle according to an embodiment of the invention shown in FIG. 7.

FIGS. 8 and 9 show schematic cross-sections along the respective lines B-B' and A-A' of the suction head of the deep-sea mining vehicle according to an embodiment of the invention shown in FIG. 7.

This cross-section particularly shows that the elements of suction head 80 together define a flow path ($P_{1-7}$) with a determined flow direction. The water inlet debouches into the pressure chamber ($P_1$). The gap-like feed opening forms the connection between the pressure chamber and the open suction side ($P_2$). The open suction side is further connected via the optional active suction space ($P_3$) to the outlet ($P_4$). $P_5$ further defines a water inflow from the surrounding area along the guide fins 807, $P_6$ a secondary water inflow from the secondary gap-like opening 814, and $P_7$ a water (in)flow from the rear side toward the effective active suction space 804 around the outer wall of pressure chamber 810 through fingers 808.

The various flow paths can combine as follows: $P_1=P_2$, $P_2+P_5+P_7=P_3$, and $P_3+P_6=P_4$. In order to pose little hydrodynamic resistance to flow path $P_7$ pressure chamber 810 is preferably positioned high enough relative to the seabed. It can further particularly be seen that internal wall part 811 comprises several identifiable segments, these together defining the form of the flow path, from the gap-like feed opening ($P_2$) to the outlet ($P_4$). A first wall part segment 811A is curved such that the distance to open suction side 803 decreases in the flow direction. First wall part segment 811A hereby preferably has a convex curvature relative to the flow path. Internal wall part 811 optionally comprises a linear middle part 811C wherein the distance to open suction side 803 remains constant. The height of linear middle part 811C relative to the plane of open suction side 803 will preferably lie between 20 and 200 mm, more preferably between 50 and 110 mm, and still more preferably between 75 and 95 mm. Internal wall part 811 also comprises a second wall part segment 811B, curved such that the distance to open suction side 803 increases in the flow direction. A third wall part segment 811D defines a part of wall part 811 which has a concave curvature relative to the flow path and connects to outlet 813.

These cross-sections particularly show that spraying water into optional active suction space 804 at high speed is realized in that the connection between secondary pressure chamber 810 and active suction space 804 consists of a second gap-like feed opening 814. Because water is sprayed with the flow direction ($P_3$ & $P_4$), mixture which has been sucked in and is situated in outlet 813 is discharged toward the rest of the deep-sea mining vehicle in accelerated manner. The advancing speed of the deep-sea mining vehicle can enhance the suction speed, particularly because the water inflow $P_5$ from the surrounding area along the guide fins 807 is supported.

The invention is not limited to the above described embodiment and also comprises modifications thereto to the extent these fall within the scope of the claims appended below.

The invention claimed is:

1. A deep-sea mining vehicle for taking up mineral deposits from a seabed at great depth, wherein the vehicle comprises:

a support frame provided with means for moving the vehicle forward on the seabed, with an at least temporary storage for the mineral deposits taken up, and with a suction head having a width and an open suction side which is directed toward the seabed and along which the mineral deposits are taken up, wherein the taking up of the mineral deposits and the transport thereof to an outlet, which is connected to a suction conduit leading to the storage, is supported by a feed opening for water which is connected to an inlet of the suction head, and by a pressure chamber for carrying the water at a high exit speed through the feed opening and toward the outlet along an internal wall part which mutually connects the feed opening and the outlet, wherein the internal wall part is curved such that the distance between the internal wall part and the open suction side of the deep-sea mining vehicle decreases from the inlet and then increases again toward the outlet, wherein the internal wall part comprises a first wall part segment which has a convex curvature from the inlet which decreases the distance between the internal wall part and the open suction side, comprises a linear middle part segment, which keeps the distance between the internal wall part and the open suction side constant, and a second wall part segment which has a concave curvature which increases the distance between the internal wall part and the open suction side and connects to the outlet, wherein the feed opening comprises a gap-like feed opening that extends over the whole width of the suction head in a direction running parallel to the width direction of the suction head and the gap-like feed opening has an upper wall which runs continuously into the wall part.

2. The deep-sea mining vehicle according to claim 1, wherein a cross-section of the gap-like feed opening is variable.

3. The deep-sea mining vehicle according to claim 1, wherein the open suction side defines a plane, and wherein the angle formed by a longitudinal axis of the suction conduit with this plane lies between 30° and 60°.

4. The deep-sea mining vehicle according to claim 1, wherein the open suction side defines a plane, and wherein the angle formed by an outflow direction of the feed opening with this plane lies between 0° and 450°.

5. The deep-sea mining vehicle according to claim 1, wherein the suction head comprises a second gap-like feed opening situated at the position of the outlet, and a second pressure chamber for carrying the water at a high exit speed through the second feed opening and toward the suction conduit which can be connected to the outlet.

6. The deep-sea mining vehicle according to claim 1, wherein a second pressure chamber is adjacent to the open suction side, and an underside of the second pressure chamber is provided with fingers for guiding taken-up mineral deposits.

7. The deep-sea mining vehicle according to claim 1, wherein at least one of the internal wall part, the pressure chamber, the second pressure chamber and the outlet extends over the width of the suction head.

8. The deep-sea mining vehicle according to claim 1, wherein the internal wall part, the pressure chamber, the second pressure chamber and the outlet extend over the width of the suction head.

9. The deep-sea mining vehicle according to claim 1, comprising a number of suction heads disposed parallel to each other.

10. The deep-sea mining vehicle according to claim 1, wherein the suction conduits which are attached to the respective suction heads disposed parallel to each other debouch into the storage.

11. The deep-sea mining vehicle according to claim 1, wherein the suction head or plurality of suction heads are height-adjustable relative to the seabed.

12. A method for taking up mineral deposits on a seabed at great depth, the method comprising of providing a deep-sea mining vehicle according to claim 1, connecting the deep-sea mining vehicle to a suspension cable provided between a floating device and the deep-sea mining vehicle, lowering the deep-sea mining vehicle toward a seabed, and moving the deep-sea mining vehicle forward over or on the seabed in order to take up the mineral deposits.

13. The deep-sea mining vehicle according to claim 1, wherein the open suction side defines a plane, and wherein the angle formed by a longitudinal axis of the suction conduit with this plane lies between 40° and 50°.

14. The deep-sea mining vehicle according to claim 1, wherein the open suction side defines a plane, and wherein the angle formed by an outflow direction of the feed opening with this plane lies between 20° and 30°.

* * * * *